US005491324A

United States Patent [19]

Vanderpool

[11] Patent Number: 5,491,324

[45] Date of Patent: Feb. 13, 1996

[54] SCORE-KEEPING-WITH-CARRY SCORE BOARDS

[76] Inventor: Frank Vanderpool, 918 Washington Ave., Iowa Falls, Iowa 50126

[21] Appl. No.: 241,480

[22] Filed: May 12, 1994

[51] Int. Cl.[6] ..... A63F 1/18

[52] U.S. Cl. ..... 235/90; 116/325; D10/46.1

[58] Field of Search ..... 235/90; 116/325, 116/326; D10/46.1

[56] References Cited

U.S. PATENT DOCUMENTS

| | | | |
|---|---|---|---|
| D. 311,870 | 11/1990 | Voorhes | D10/46.1 |
| 766,545 | 8/1904 | Sterl | 235/90 |
| 805,988 | 11/1905 | Palmer | 235/90 |
| 2,740,585 | 4/1956 | Cox | 235/90 |
| 3,051,490 | 8/1962 | Newman | 235/90 |
| 3,195,813 | 7/1965 | Hart | 235/90 |
| 3,905,547 | 9/1975 | Cyre et al. | 235/90 |

*Primary Examiner*—Cassandra C. Spyrou

[57] ABSTRACT

The present inventions are score-keeping-with-carry score boards and are specifically suited by design for accumulating and displaying points during the play of games like cribbage, rummy or five hundred euchre but not limited to these. The present inventions are very "pocket-able" or conveniently portable score boards.

6 Claims, 4 Drawing Sheets

SCORE-KEEPING-WITH-CARRY SCORE BOARDS

TECHNICAL FIELD

The present inventions are related to score-keeping-with-carry score boards and are specifically suited by design for accumulating and displaying points during play of games like cribbage, rummy or five hundred euchre but not limited to these.

DESCRIPTION OF THE PRIOR ART

Prior art for score-keeping has been limited to the pencil and paper method by writing and calculating the scores out in long-hand for many games of cards like rummy or five hundred euchre. Carrying pencil, paper and some playing cards with you leads to problems like re-sharpening pencils, pens drying up, running out of paper or simply the inconvenience of transporting several loose items. Also, when totaling points long-hand, errors can more easily be made and can take more time to add up when compared to using the present invention.

Prior art in game boards and more specifically score boards have taught similar methods in their approach to playing areas which is the amount of area supplied for the players to play the game. The score board playing area sizes were large in relation to the amount and type of information that needs to be communicated to the players, such as who has the most points and is presently winning the game. This size ratio relates to the convenience of portability in prior art score boards; larger score boards meant larger ratios and more inconvenience.

Cribbage is a game in the past that has taught the use of larger score boards. Its prior art is extensive and the game is old and well known; so for the sake of brevity no formal explanation of the game rules will be included. The improvements are in how to keep score of the game points which effects the size of the score board and not how to make points in the game. These improvements are accomplished by considering certain factors.

Several factors effect this size ratio in score boards, especially for the game of cribbage. The most important factors are the value, quantity and size of the holes or data sites; and the storage provided for pegs or indicators and for the playing card decks.

The prior art for cribbage score boards teaches the use of pegs placed into holes on a board of some material. The holes represented a point value of one and the pegs were moved from hole to hole basically one point at a time. This value factor creates the problem of the second factor.

The second factor effecting board size was the quantity of holes that had to be used to play the game and show the player positions. Excluding the game hole in cribbage, it requires 120 points to win the game. Prior art in cribbage score boards has taught the use of various but large quantities of holes; such as two rows of 30 for a total of 60 holes per player (or partners if 4 players); or one row of 120 holes and when not in a straight line are weaved around on the score board in a pattern. The large quantities of holes used for communicating game points created a separate problem related to board size which is the recognition of player positions on the score board.

The loss of position was possible if less than 120 holes were used to score the game. When for example, two rows of 30 holes are used, the players must move their pegs twice around the two rows of holes creating the opportunity for the loss of position. The loss of position can also be accountable to holes not having individual markings or identification so that even when 120 holes are used, player positions are not instantly recognizable.

In the U.S. Pat. No. 3,905,547 Cyre et al. teaches the use of 122 numbered divisions for keeping score to show player position. This allows the scorer who has the score board in front of him to see player positions by reading each player's score. It becomes a problem for the other players to readily see their position in relation to the others. Some prior art has markings or numbered positions in five point increments such as U.S. Pat. No. Des. 311,870 Voorhees but this still relates to the value factor problem of scoring one point at a time.

The last factor considered is the size of the holes and pegs used to designate the player scores or positions. The hole diameters must be kept small when used with the prior art in order to keep the score boards from becoming even larger. Some types of pegs used were very small such as wooden match sticks as Cyre teaches or very small carpenter finishing nails making the handling of pegs during play another problem.

The storage of pegs and playing card decks becomes a problem when starting with a larger score board because any increase in size adds to the inconvenience of its portability.

SUMMARY OF THE INVENTION

It is an objective of the present invention to provide score-keeping-with-carry score boards reducing the need for the pencil and paper method of scoring points for games like rummy or five hundred euchre. Also, an improved cribbage score board is disclosed providing many advantages over prior art as stated herein and as will be seen in the detailed description and drawings. The score boards are preferably fabricated from plastic but wood or die-cast metals will work well because of its small size. The rounded edges and corners add to its convenience in portability making it well suited for games like cribbage, rummy and five hundred euchre but not limited to these.

It is a further objective of the present invention to provide a score-keeping-with-carry system for accumulating and totaling points faster, more accurately and reliably than prior art. The data sites provide a greatly increased accuracy for scoring points because of their numerical identification allowing quicker recognition of player position and eliminates the possible loss of position. The data sites of the present invention have multiple point-values allowing the reduction in quantity and increase in their size. The present invention permits a reduction in playing area size or display area size that produces a very low size ratio and provides a very "pocket-able" or conveniently portable score board.

It is a further objective of the present invention to provide ergonomically-enhanced score boards with small conveniently sized display areas which are very observable and readable for all players. The present invention allows the use of larger holes or data sites and larger sized pegs or indicators improving the handling of indicators during play of the game.

It is a further objective of the present invention to provide storage compartments and retain convenient and highly portable score boards. This is accomplished by starting with a small size ratio score board and adding walls to the sides and behind the score board.

Other advantages can be seen during the review of the drawings. Preferred embodiments are disclosed but do not limit the present invention to only the disclosed embodiments or to any modifications within the scope of the present claimed invention.

BRIEF DESCRIPTION OF THE DRAWINGS

Score-keeping-with-carry score boards are in views to show uniqueness and advantages.

FIG. 1 is a perspective view of the first preferred embodiment for the game of cribbage; further described as the score board 10 and the score board 10' of FIG. 3 in their mated position;

DETAILED DESCRIPTION OF THE DRAWINGS

The preferred process of injection molding plastic is used for constructing two virtually identical score boards and incorporating the container means and a physical means to record information. The injection molding process is used for all embodiments disclosed including score boards 10, 10', 10", 48, 52 and 58 of FIGS. 2, 3, 4, 7, 8 and 13, respectively. For sake of brevity and clarity, score boards 10, 10' and 10" will suffice to describe the present invention as unique and different. Modifications represented in other embodiments will be described in the applicable section.

Figure 1:
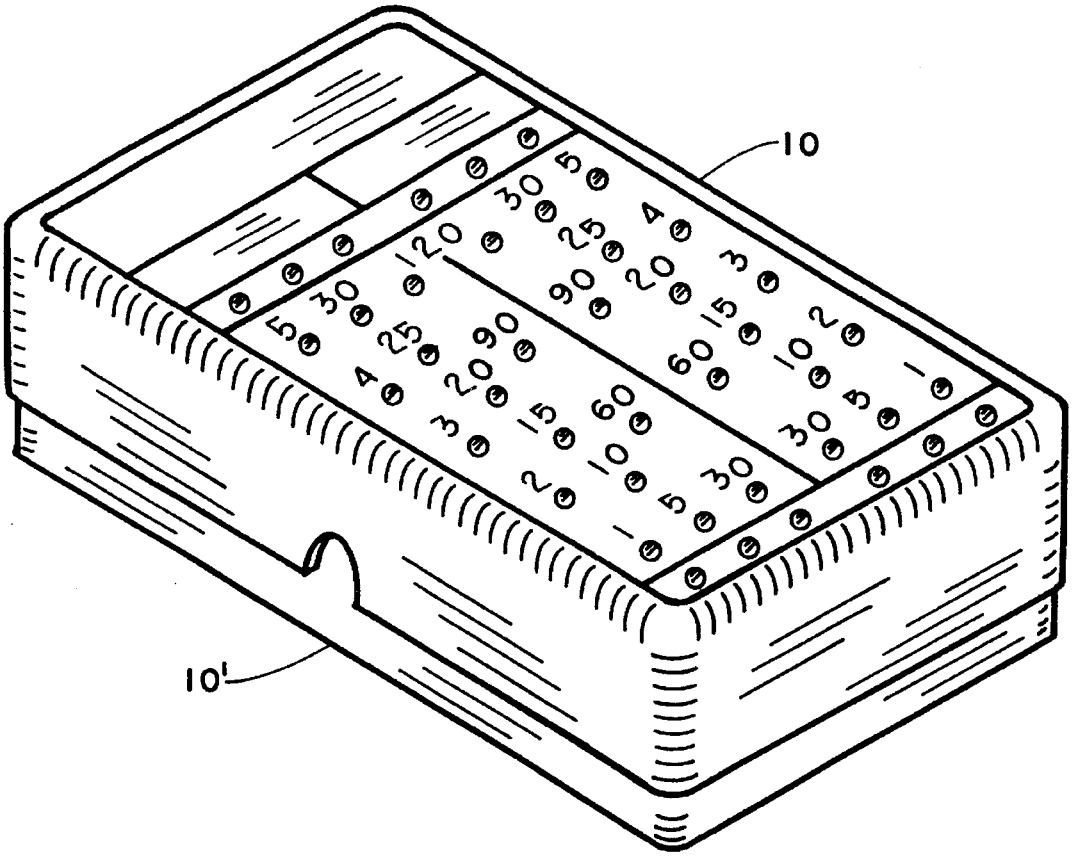
FIG. 1 is for publication.
Figure 2:
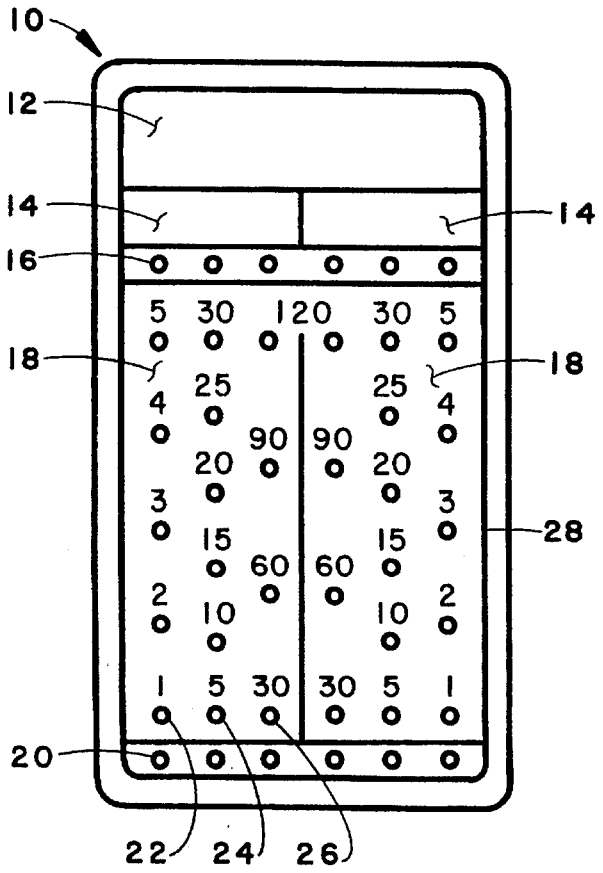
FIG. 2 is a front view of. The score board 10 of FIG. 1.
Figure 3:
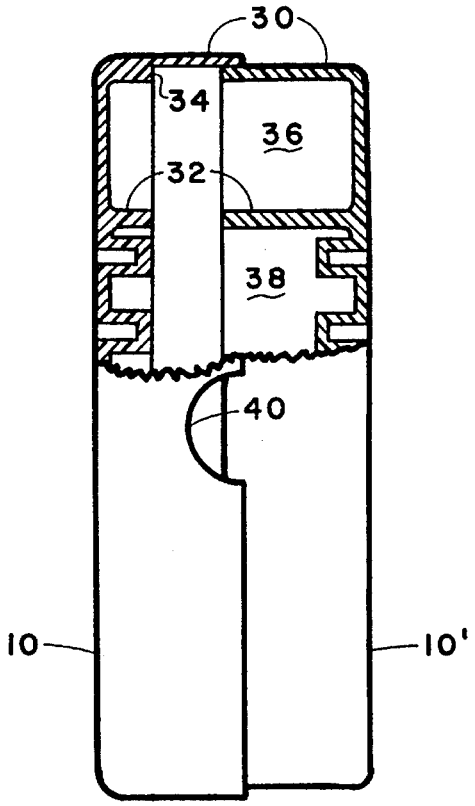
FIG. 3 is a partial section view of the side view of FIG. 1 in telescoped position; further described as the score board 10 sectioned on line 3—3 of FIG. 9 and score board 10' sectioned on line 3—3 of FIG. 10.

Referring to FIG. 2 and FIG. 3, the elements for construction of the score-keeping-with-carry system comprises the score board 10 with side walls 30 along with games-won positions 16, home-base positions 20 and display areas 18 which consist of data sites 22, 24 and 26 of several different point-values but having the same basic construction, internal side walls 32, telescoping-stops 34 and finger-reliefs 40. The score board 10' is virtually identical but without the telescoping-stops 34 and finger-reliefs 40 and has shorter length and width than score board 10 from the outside border 28 to the outside of the side walls 30.

Figure 9:
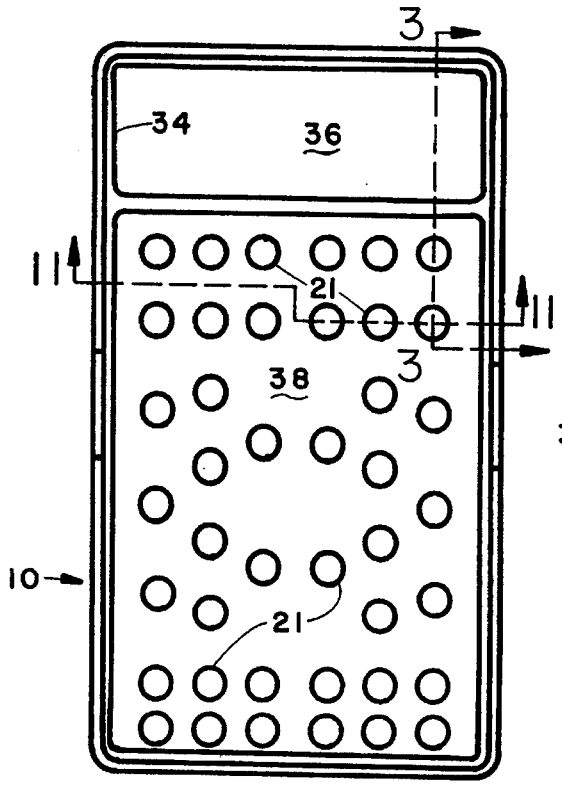
FIG. 9 is a rear view of FIG. 2.

The container means as referenced in FIG. 3 uses the side walls 30 as mating surfaces: the inside surfaces of the side walls 30 of score board 10 telescope over the outside surfaces of the side walls 30 of score board 10' forming a first compartment 38 and a second compartment 36. The first compartment 38 is separated from the second compartment 36 by the internal side walls 32. The internal side wall 32 in score board 10 has a length making it level with the telescoping-stops 34 in score board 10 and the internal side wall 32 in score board 10' has a length making it level with the side walls 30 in score board 10'. The telescoping together of the score boards 10 and 10' is limited by telescoping-stops 34 in score board 10 and FIG. 9 shows the telescoping-stops 34 extending around the inside perimeter of score board 10. The telescoping apart of the score board 10 and 10' is more easily accomplished by using the finger-reliefs 40 centered on the edges of two opposite side walls 30 of score board 10.

Figure 10:
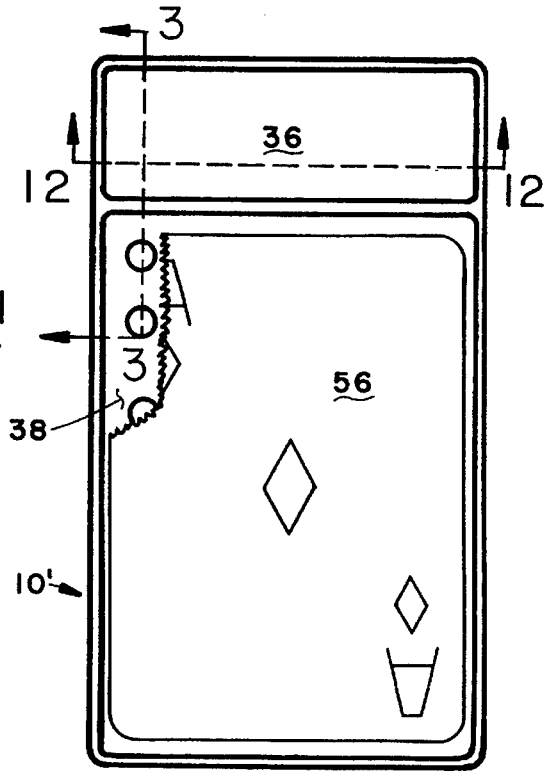
FIG. 10 is a rear view of the score board 10' of FIG. 3; further described by placement of a standard playing card deck 56 in the first compartment 38.
Figure 11:
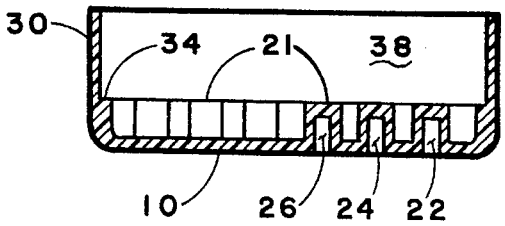
FIG. 11 is a section view taken on line 11—11 of FIG. 9.

The first compartment 38 of the container means is further described in FIG. 9, FIG. 10 and FIG. 11. In FIG. 10, an ordinary playing card deck is shown describing the size of the first compartment 38 as sufficiently long and wide to loosely store at least one ordinary playing card deck. In FIG. 11, the bottoms 21 of data sites 22, 24 and 26, games-won positions 16 and home-base positions 20 have the same basic construction providing flat surfaces and an aggregately planar surface to facilitate the storage of an ordinary playing card deck 56.

Figure 12:
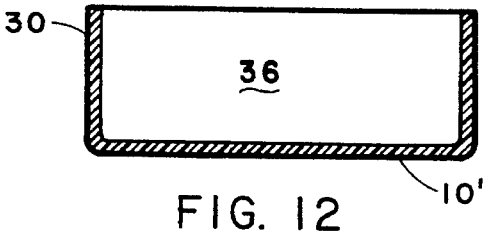
FIG. 12 is a section view taken on line 12—12 of FIG. 10.

The second compartment 36 in the container means is further described in FIG. 9, FIG. 10 and FIG. 12. In referring to FIG. 9 and FIG. 10, the location and size of the second compartment 36 is further described relative to the first compartment 38; and FIG. 12 describes the second compartment 36 as having storage room for a multiple of indicators 44.

Figure 6:
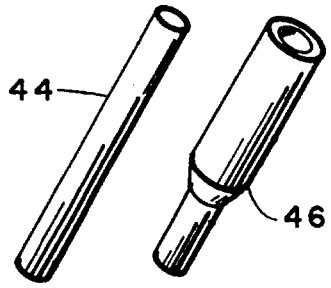
FIG. 6 is perspective views of two indicator embodiments.

The first physical means to record information on the score board 10 and 10' as referenced in FIG. 2 and further described in FIG. 3 and FIG. 11, is games-won positions 16, home-base positions 20 and data sites 22, 24 and 26 having holes formed into the score boards 10 and 10' for use with indicators 44 or 46 of FIG. 6.

Figure 4:
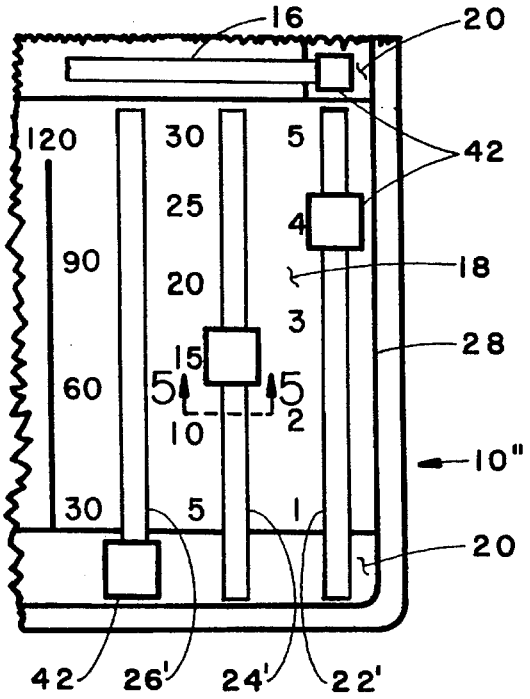
FIG. 4 is a partial front view of score board 10" which is the first preferred embodiment for the game of cribbage disclosing the second means for physically recording information and an appropriate embodiment of indicator.
Figure 5:
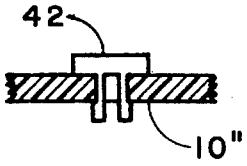
FIG. 5 is a partial section view taken on line 5—5 of FIG. 4.

The second physical means to record information on the score board 10" as referenced in FIG. 4 and further described in FIG. 5, is games-won positions 16, home-base positions 20 and data sites 22', 24' and 26' having slots for use with indicators 42 of FIG. 4 and FIG. 5. The slots are interconnected to allow the indicators 42 to slide along the slots between data sites 22', 24' and 26' having the same point-values and their respective home-base positions 20.

The indicators 42 of FIG. 4 and FIG. 5 are made of plastic by injection molding or extrusion processes and are designed to be held in the slot by the tabs on the underside of the indicators 42 having ends larger than the tab itself for slideably holding the indicators 42 in the slots when the indicator 42 tabs are pushed into the slot.

The indicators 44 of FIG. 6 are made by injection molding or extrusion processes to make a peg of a length for grasping by the fingers the hand and of a diameter to slideably fit into games-won positions 16, home-base positions 20 and data sites 22, 24 and 26 having holes as referred to in FIG. 2.

Figure 13:
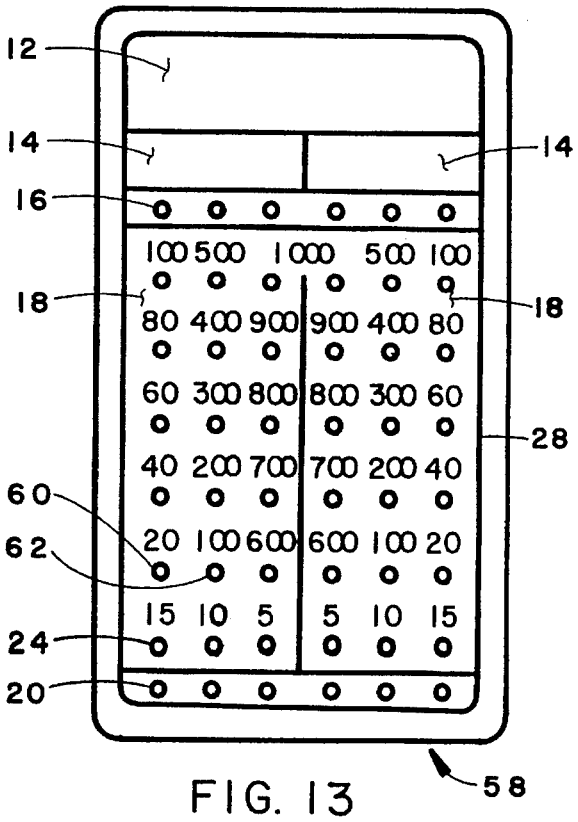
FIG. 13 is a front view of a score board 58 which is the first preferred embodiment for games like rummy or five hundred euchre.

The indicators 46 of FIG. 6 are made by an injection molding process in order to provide the added features for use with score board 58 of FIG. 13. The indicators 46 have at one end a smaller diameter section than the body allowing a slideable fit into games-won positions 16, home-base positions 20 and data sites 24, 60 and 62 as referred to in FIG. 13. The other end of the indicators 46 has a hole of size that allows a slideble fit with the opposite end of another indicator 46 producing a stacking capability.

The indicators 44 and 46 of FIG. 6 can be used in any of the score board embodiments but the stacking capability of indicator 46 is not required in any of the cribbage game embodiments such as score boards 10, 10', 48 and 52 of FIGS. 2, 3, 7 and 8, respectively. The elements for the general construction of the present claimed invention now being disclosed provides for a better understanding of the following general layout of the present claimed invention and the art of its usage.

The score boards 10, 10', 10", 48, 52 and 58 of FIGS. 2, 3, 4, 7, 8 and 13, respectively are included for the following description. Score board 10" is identical to score board 10 in all elements excepting the physical means to record information and the appropriate indicator embodiment. The elements are such that a painted or hot-stamped border 28 circumscribes the following elements, while adjacent elements share a common border 28: a score board's name area 12, player name areas 14, games-won positions 16, home-base positions 20 and mirror-image display areas 18 consisting of a plurality of data sites. The shared border 28 between the mirror-image display areas 18 has a break in it at one end and points to the highest numerical identification on the score boards.

In further describing of these elements, the score board's name area 12 will be used for painting or hot-stamping a name of the score board into during manufacture. The player name areas 14 have no indicia until the players decide what to write within these areas using felt tip markers as are commonly available giving them the option of changing what they write. These areas can thus be personalized with their name or initials or more general terms or numbers. This would normally be done once prior to first use but can be changed later. After the players have decided which player name area 14 to use, the games-won positions 16, display area 18 and home-base positions 20 adjacent to their player name area 14 will be used by that player during play of the entire game.

The games-won positions 16 record the number of games won by each player. The first game won by a player results in an indicator 44 being placed into the outermost games-won position 16 of the winning player. This indicator 44 is moved to the next games-won position 16 at the next game won by the same player and likewise for the player's opponent; each player moving his indicator 44 towards the center. As disclosed, the games-won positions 16 will record three games won per player; and playing a seventh game makes it best four games out of seven. But this is not meant to be an upper or lower limit-on the games-won positions 16.

The home-base positions 20 are for placing the indicators 44 at the start of a game and represent no value. There is a home-base position 20 for each indicator 44 used during play of the game.

Score board 10" requires this clarification: the indicators 42 are slid from one games-won position 16 to the next and a home-base position 20 is provided at the outer end of the slot for an indicator 42.

The mirror-image display areas 18 are the sections of the score board used to communicate the point totals and player positions during play of the game. In general, the slight modifications between the various score board embodiments are in the numerical bases used effecting display area 18 arrangements due to added and subtracted data sites of different point-values.

Referring to FIG. 2, one display area 18 of the score board 10 is used by a player during play of the game. A description of one display area 18 will describe both mirror-image display areas 18; the only difference is in the mirror-image with no changes in the basic usage. The display area 18 consists of data sites 22, 24 and 26: having multiple point-values, having numerical identification, having specific reusing capability and having at least one numerical base in order to transfer or "carry" points between the multiple point-values.

In further reference of FIG. 2, numerical identifications go hand in hand with the point-values given to the various data sites 22, 24 and 26. The numerical identifications for data sites 22 having a one point-value are "1", "2", "3", "4" and "5"; for data sites 24 having a five point-value are "5", "10", "15", "20", "25" and "30"; and for data sites 26 having a thirty point-value are "30", "60", "90" and "120". The numerical identifications "5" and "30" are duplicated in the multiple point-values for use with different numerical bases allowing points to be transferred or "carried" between data sites 22 of one point-value and data sites 24 of five point-value; and points are "carried"between data sites 24 of five point-value and data sites 26 of thirty point-value.

Reusing data sites 22 and 24 having one and five point-values, respectively, by transferring or "carrying" the points from the lowest point-value data site 22 up to the highest point-value data site 26, in sequence, is how the display area 18 uses different numerical bases to accumulate points and to record and display player position.

The numerical bases are equal in value to the numerical identifications of the highest value for each of the different point-values for the data sites 22, 24 and 26; thus for data sites 22 of one point-value the numerical base is 5; for data sites 24 of five point-value the numerical base is 30; and for data sites 26 of thirty point-value the numerical base is 120. The numerical bases 5, 30 and 120, represent the total points that can be accumulated with the one, five and thirty point-value data sites 22, 24 and 26, respectively. It will be apparent that the specification of certain numerical bases does not exclude the use of other bases which might be suitable to other specific games to be score, but that the specification of these bases is merely exemplary.

The following descriptions in table form of the indicator 44 movements for an example cribbage game show how the winning player's points for nine hands are recorded in the display area 18. The total points received per hand are shown which includes any crib points received for that hand alongside the accumulating point total for the game.

Refer to FIG. 2 and the following Table No. 1 and note these explanations for its usage.

First, the letters "HB" symbolize home-base positions 20. The home-base position 20 for each respective point-value can be used with the closest data sites 22, 24 and 26 although not required.

Secondly, the numerals on each side of the hyphen (the form shown here: xx—xx) represent the location of the data site by its numerical identification in the respective point-value of which an indicator 44 is to be removed from and placed into. The indicator 44 moves are meant as a learning aid for it is incalculable to show the variety of moves possible on the score board 10 since the hand totals and game totals constantly vary. Each indicator 44 for the data sites 22, 24 and 26 of one, five and thirty point-value, respectively, has separate moves listed in an order to help learn the use of the score board 10. As skills increase in the score board's 10 use almost any indicator 44 can be moved first.

Finally, the count refers to the mental counting that a player could do while moving the indicators 44 and with the move of the last indicator 44 should equal the hand total.

Describing the indicator 44 moves for the respective point-values for the first hand, from the Table No. 1, movement no. 1: HB-5 means to move an indicator 44 from the home-base position 20 and place it into data site 24 "5" and the player mentally counts 5 and again from Table No. 1 the second movement: HB-1 means to move an indicator 44 from home-base position 20 and place it into data site 22 "1", and counting it 6. The third movement from Table No. 1:5–10 means to move an indicator 44 from data site 24 "5" to data site 24 "10" and count 5. By continuing in this manner the points can be recorded for all hands showing one solution for recording the game points.

A second solution for recording the example game points is shown in Table No. 2. A comparison can be made by using the same hand totals where by Table No. 1 shows how a beginner in the game of cribbage might utilize the present invention's score-keeping capabilities and Table No. 2 shows how an experienced player practised with the present invention could record the game points by using addition, carry and borrow.

TABLE NO. 1

CRIBBAGE GAME EXAMPLE (ONE PLAYER)

| | | INDICATOR 44 MOVEMENTS FOR: | | |
|---|---|---|---|---|
| MOVE-MENT No. | HAND/ GAME TOTALS | ONE POINT-VALUE DATA SITES 22 MOVE - COUNT | FIVE POINT-VALUE DATA SITES 24 MOVE - COUNT | THIRTY POINT-VALUE DATA SITES 26 MOVE - COUNT |
| 1 | 6/5 | | HB - 5 5 | |
| 2 | /6 | HB - 1 6 | | |
| 3 | 6/11 | | 5 - 10 5 | |
| 4 | /12 | 1 - 2 6 | | |
| 5 | 17/27 | | 10 - 25 15 | |
| 6 | /29 | 2 - 4 17 | | |
| 7 | 4/30 | 4 - 5 1 | | |
| 8 | /33 | 5 - 3 4 | | |
| 9 | | | 25 - 30 Carry 5 | |
| 10 | | | 30 - HB | |
| 11 | | | | HB - 30 Carry 30 |
| 12 | 29/58 | | HB - 25 25 | |
| 13 | /60 | 3 - 5 27 | | |
| 14 | /62 | 5 - 2 29 | | |
| 15 | | | 25 - 30 Carry 5 | |
| 16 | | | 30 - HB | |
| 17 | | | | 30 - 60 Carry 30 |
| 18 | 18/77 | | HB - 15 15 | |
| 19 | /80 | 2 - 5 18 | | |
| 20 | | 5 - HB | | |
| 21 | | | 15 - 20 Carry 5 | |
| 22 | 22/90 | | 20 - 30 10 | |
| 23 | /100 | | 30 - 10 20 | |
| 24 | /102 | HB - 2 22 | | |
| 25 | | | | 60 - 90 Carry 30 |
| 26 | 14/112 | | 10 - 20 10 | |
| 27 | /115 | 2 - 5 13 | | |
| 28 | /116 | 5 - 1 14 | | |
| 29 | | | 20 - 25 Carry 5 | |
| 30 | 5/121 | | 25 - 30 5 | |
| 31 | | | 30 - HB | |
| 32 | | | | 90 - 120 Carry 30 |

The indicators 44 display a total of 121 points for game won.

TABLE NO. 2

CRIBBAGE GAME EXAMPLE
Table No. 2 note: one experienced player practised with the present invention.

| | | INDICATOR 44 MOVEMENTS FOR: | | |
|---|---|---|---|---|
| MOVE-MENT No. | HAND/ GAME TOTALS | ONE POINT-VALUE DATA SITES 22 MOVE - COUNT | FIVE POINT-VALUE DATA SITES 24 MOVE - COUNT | THIRTY POINT-VALUE DATA SITES 26 MOVE - COUNT |
| 1 | 6/5 | | HB - 5 5 | |
| 2 | /6 | HB - 1 6 | | |
| 3 | 6/11 | | 5 - 10 5 | |
| 4 | /12 | 1 - 2 6 | | |

TABLE NO. 2-continued

CRIBBAGE GAME EXAMPLE
Table No. 2 note: one experienced player practised with the present invention.

| | | INDICATOR 44 MOVEMENTS FOR: | | |
|---|---|---|---|---|
| MOVE-MENT No. | HAND/ GAME TOTALS | ONE POINT-VALUE DATA SITES 22 MOVE - COUNT | FIVE POINT-VALUE DATA SITES 24 MOVE - COUNT | THIRTY POINT-VALUE DATA SITES 26 MOVE - COUNT |
| 5 | 17/27 | | 10 - 25 15 | |
| 6 | /29 | 2 - 4 17 | | |
| 7 | 4/28 | 4 - 3 Borrow 1 | | |
| 8 | /33 | | 25 - 30 5 | |
| 9 | 29/32 | 3 - 2 Borrow 1 | | |
| 10 | /62 | | | HB - 30 30 |
| 11 | 18/77 | | 30 - 15 15 | |
| 12 | /77 | | | 30 - 60 Carry 30 |
| 13 | /80 | 2 - 5 18 | | |
| 14 | 22/100 | | 15 - 5 20 | |
| 15 | /100 | | | 60 - 90 Carry 30 |
| 16 | /102 | 5 - 2 22 | | |
| 17 | /102 | | 5 - 10 Carry 5 | |
| 18 | 14/101 | 2 - 1 Borrow 1 | | |
| 19 | /116 | | 10 - 25 15 | |
| 20 | 5/121 | | 25 - 30 5 | |

The indicators 44 display a total of 121 points for game won.

There are movements that can be combined into a single movement. In referring to Table No. 2, movement no.s 14 and 17 could be combined into one movement: 15–10 Count 25, meaning to add 20 and carry 5. The Tables 1 and 2 show the flexibility in the present invention to fit the experience of the players. The flexibility of the present invention can be seen in the descriptions for the other embodiments for cribbage, refer to FIG. and FIG. 8, score board 48 and 52, respectively. They both use the same method for recording points as score board 10 in FIG. 2 but use different numerical bases with the appropriate modifications in the display areas 18.

Figure 7:
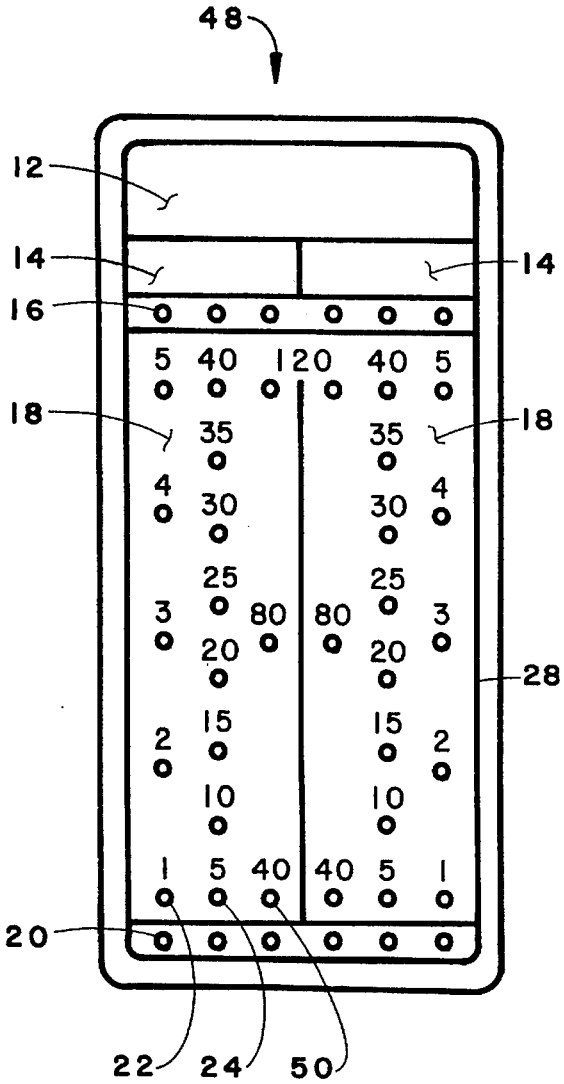
FIG. 7 is a front view of a score board 48 which is a second embodiment for the game of cribbage.

Refer to FIG. 7 to see the modifications in the display areas 18 on score board 48. The numerical base for the five point-value data sites 24 is increased to 40 and two five point-value data sites 24 are added with the numerical identifications "35" and "40". The next higher point-value data sites 50 are correspondingly changed to forty point-value and have numerical identifications "40 ", "80" and "120". These changes effect the "carry" or amount of points transferred to the data sites 50 of highest point-value and to the quantity of movements an indicator 44 will make to get to the data site 50 with the highest numerical identification of "120".

Figure 8:
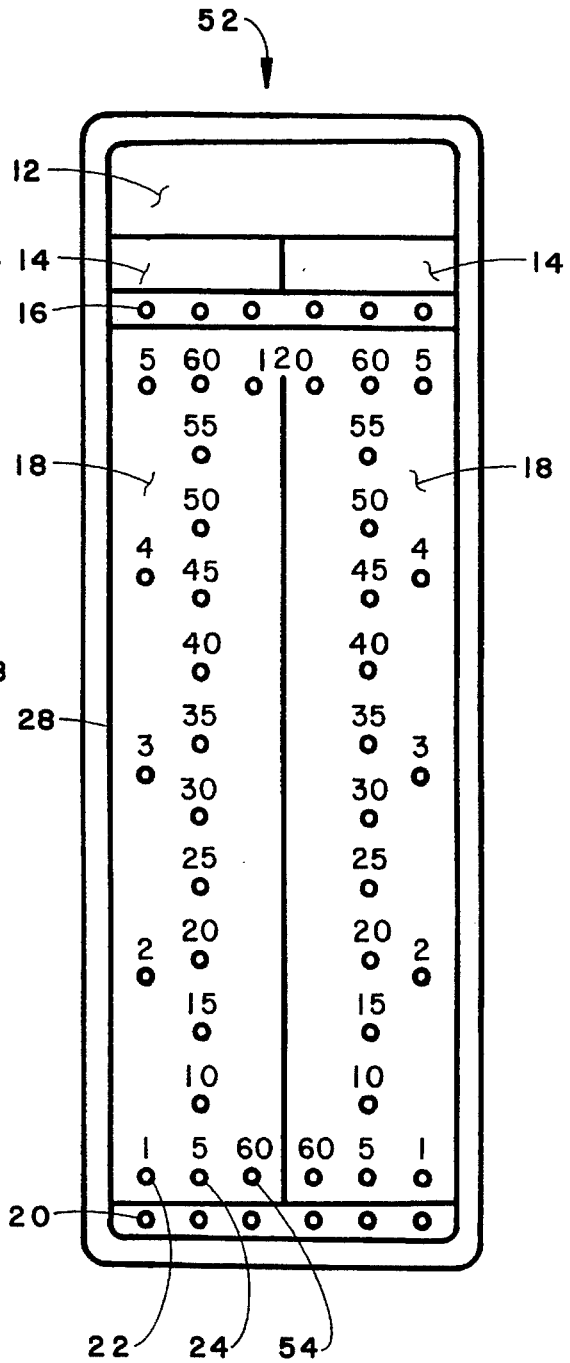
FIG. 8 is a front view of a score board 52 which is a third embodiment for the game of cribbage.

Refer to FIG. 8 to see the modifications in the display areas 18 on score board 52. The numerical base for the five point-value data sites 24 is increased to 60 and six five point-value data sites 24 are added with the numerical identifications "35", "40", "45", "50", "55" and "60". The next higher point-value data sites 54 are correspondingly changed to sixty point-value and have numerical identifications "60" and "120". These changes effect the "carry" or amount of points transferred to the data sites 54 of highest point-value and to the quantity of movements an indicator 44 will make to get to the data site 54 with the highest numerical identification of "120".

Refer to FIG. 13, the score board 58 discloses an embodiment of the present invention for use with games like rummy and five hundred euchre. Games like these are scored in increments of 5, 10 and 20 points; the score board 58 permits these different point increments to be used for recording points in the display areas 18. The score board 58 uses the same method of recording points as described in Tables 1 and 2 for score board 10 of FIG. 2 and as shown by example in Tables 1 and 2 of the detailed description. The score board 58 has numerical bases 20, 100 and 1000 for data sites 24, 60 and 62 of five, twenty and one hundred point-value, al 1 respectively.

The five point-value data sites 24 have numerical identifications "5", "10" and "15". The twenty point-value data sites 60 have numerical identifications "20", "40", "60", "80" and "100". The one hundred point-value data sites 62 have numerical identifications "100", "200", "300", "400", "500", "600", "700", "800", "900" and "1000" The numerical identification "100" is duplicated in the multiple point-value data sites 60 and 62. Points are "carried" between the multiple point-value data sites 24, 60 and 62 as described but with three modifications.

The first modification is the score board 58 does not have a five point-value data site 24 with numerical identification "20" which modifies when the "carry" must be done from the five point-value data sites 24 to the twenty point-value data sites 60. The numerical base for the five point-value data sites 24 is 20 and the total points that can be accumulated with the five point-value data sites 24 is 15, which means anytime an even 20 points are accumulated, the 20 points must be "carried" immediately to the twenty point-value data sites 60 and the indicator 46 moved from the five point-value data sites 24 to a home-base position 20.

The second modification is the score board 58 provides the players with a choice in the size of the point increments used for recording the game points. The score board 58 provides for recording points in the useful increments of 5, 10 and 20. Three indicators 46 are used to record in 5 and 10 point increments and two indicators 46 are used for 20 point increments.

The third modification is the score board 58 discloses total flexibility in the pattern layouts of data sites in general for all score boards and specifically for the data sites 24, 60 and 62; the numerical identifications control and direct the indicator 46 movements.

The following descriptions in table form of the indicator 46 movements are for games recorded in 5, 10 and 20 point increments. Refer to FIG. 13 and the following Table No. 3 and note its usage similar to Tables 1 and 2 except two or three indicators 46 can be used with five, twenty and one hundred point-value data sites 24, 60 and 62, respectively, as the game requires.

TABLE NO. 3

MULTIPLE GAMES EXAMPLE
Table No. 3 note: accumulating total from largest to smallest increments. The count with "C" means "carry" included.

| MOVE-MENT No. | HAND/ GAME TOTALS | FIVE POINT-VALUE DATA SITES 24 MOVE - COUNT | TWENTY POINT-VALUE DATA SITES 60 MOVE - COUNT | ONE-HUNDRED POINT-VALUE DATA SITES 62 MOVE - COUNT |
|---|---|---|---|---|
| 1 | 20/20 | | HB - 20 20 | |
| 2 | 40/60 | | 20 - 60 40 | |
| 3 | 180/140 | | 60 - 40 80 | |
| 4 | /240 | | | HB - 200 180C |
| 5 | 220/260 | | 40 - 60 20 | |
| 6 | /460 | | | 200 - 400 220 |
| 7 | 10/470 | HB - 10 10 | | |
| 8 | 10/480 | 10 - HB 10 | | |
| 9 | /480 | | 60 - 80 Carry 20 | |
| 10 | 250/490 | HB - 10 10 | | |
| 11 | /530 | | 80 - 20 50 | |
| 12 | /730 | | | 400 - 700 250C |
| 13 | 45/735 | 10 - 15 5 | | |
| 14 | /775 | | 20 - 60 45 | |
| 15 | 35/790 | 15 - 10 15 | | |
| 16 | /810 | | 60 - 100 35C | |
| 17 | 55/825 | 10 - 5 15 | | |
| 18 | /865 | | 100 - 60 55 | |
| 19 | /865 | | | 700 - 800 Carry 100 |
| 20 | 135/880 | 5 - HB 15 | | |
| 21 | /900 | | 60 - 100 35C | |
| 22 | /1000 | | | 800 - 900 135 |

The indicators 46 display a total of 1000 points.

Refer to FIG. 13, one display area 18 of the score board 58 can be used with two sets of indicators 46, each set a different shade of the same color, the darker shade for the positive game points and the lighter shade for the negative game points. Several recording situations occur when adding and subtracting from the game point totals.

The disclosed method of recording points covers the first two situations: adding points to a positive game point total and subtracting points from a negative game point total; as both situations increase the absolute value of the game point total.

The disclosed method of recording points used in a reversible manner covers two more situations: subtracting points from a positive game point total and adding points to a negative game point total; as both of these situations decrease the absolute value of the game point total. During the last two situations a special situation will occur when the game point total goes from positive to negative and from negative to positive.

In this special situation, the indicators 46 are moved thus: first, total the points displayed by the indicators 46, whether positive or negative, then remove this set of indicators 46 of the one color shade from the display area 18 and switch this set with the set of indicators 46 of the other color shade in the home-base positions 20; then continue by recording points starting at the total points that were displayed and moving the indicators 46 of the new color shade to the data sites 24, 60 and 62 where the new total displayed and the old total would equal the amount of points being added or subtracted for that hand.

Refer to FIG. 13 for this example, consider as if indicators 46 are at data sites 24, 60 and 62 marked with "15", "40" and "200", respectively. The indicators 46 would display a total of 255 points, whether positive or negative; the same indicator 46 movements would be required in either case.

For clarity of explanation, a loss of 390 points will be subtracted from a positive game point total of 255 points: first, remove the darker color shade of indicators 46 from the data sites 24, 60 and 62 marked with "15", "40" and "200" and place them in the home-base position 20 in place of the set of indicators 46 of the lighter color shade. Using the lighter color shade set of indicators 46, move one indicator 46 to the data site 62 marked "100" and count 355. Then move another indicator 46 to the data site 60 marked "20" and count 375. Move the last indicator 46 to the data site 24 marked "15" and count 390. The indicators 46 now display a negative game point total of 135 points.

The stacking capability of the indicator 46 can be used to allow two players to record points in the same display area 18. The indicators 46 are of different colors for each player and when indicators 46 of the two players are at the same data site 24, 60 and 62, either player's indicator 46 can be set into the top of the other player's indicator 46.

The present invention having been fully disclosed and described herein for the preferred embodiments, and with recognition of modifications of the present invention for future embodiments, and the disclosed details not to be limiting, the present claimed invention is to have full accordance of the claims so as to embrace any and all equivalent devices and apparatus.

What I claim is:

1. A score-keeping-with-carry system comprising: At least one score board comprising:

at least one display area for point totals comprising virtual mirror-image display areas;

a plurality of indicators;

means for calculating point-value changes on said score board so as to accumulate and display the point totals; said calculating means comprising a plurality of data sites having numerical identification and multiple point-values associated with each of said data sites, respectively;

each of said virtual mirror-image display areas including at least three columns of said data sites; the numerical identification and multiple point values associated with the data sites of each of said columns having a numerical base different than a numerical base of any other of the columns of said data sites;

means for physically recording information for displaying the point totals on said score board such that said indicators designate said data sites.

2. The system of claim 1, further comprises a means for containing at least one playing card deck in a first compartment and said indicators in a second compartment.

3. The system of claim 2 wherein said at least one score board comprises two score boards: each of said two score boards comprising side walls substantially perpendicular thereto, wherein said side walls of a first of said of two score boards telescopingly mates with the side walls of a second of said two score boards.

4. The system of claim 3, in which each of said score boards, said indicators, and said side walls are constructed from a material selected from a group consisting of: plastic, wood and die-cast metal.

5. The system of claim 1, by said means for physically recording information comprises said score board having holes for use with said indicators.

6. The system of claim 1, whereby said means for physically recording information comprises said score board having slots for use with said indicators.

* * * * *